United States Patent [19]

Chang et al.

[11] Patent Number: 4,755,501

[45] Date of Patent: Jul. 5, 1988

[54] COLOR DEVELOPING COMPOSITION FOR CARBONLESS PAPER COPYING SYSTEM

[75] Inventors: Yew C. Chang, Westlake Village, Calif.; Richard S. Lamar, Littleton, Colo.

[73] Assignee: Amoco Corporation, Chicago, Ill.

[21] Appl. No.: 612,044

[22] Filed: May 18, 1984

[51] Int. Cl.[4] ..... B41M 5/16; B41M 5/22

[52] U.S. Cl. ..... 503/207; 427/150; 427/151; 428/341; 428/342; 503/213; 503/216; 503/225

[58] Field of Search ..... 346/209, 213, 216, 225; 427/150–152; 428/341, 342; 503/207, 209, 213, 216, 225, 226

[56] References Cited

U.S. PATENT DOCUMENTS

| | | | |
|---|---|---|---|
| 4,245,857 | 1/1981 | Satomura | 346/213 |
| 4,467,339 | 8/1984 | Asami et al. | 346/225 |
| 4,480,260 | 10/1984 | Yamato et al. | 346/225 |

*Primary Examiner*—Bruce H. Hess

*Attorney, Agent, or Firm*—William H. Magidson; Ralph C. Medhurst

[57] ABSTRACT

A color developing composition for pressure-sensitive recording systems comprising an admixture of an alkylidenediphenol and calcium carbonate having a weight ratio of about 2 parts to about 20 parts phenol per 100 parts calcium carbonate. The admixture is formulated in high solids content coating colors having excellent rheological property and stabilty, which are used to produce CF sheets having a coating weight of about 4 to about 10 g/$m_2$. Preferably, the composition comprises Bisphenol A in an amount of 4 to 10 parts per 100 parts calcium carbonate and the calcium carbonate weight % in the CF coating is greater than 50%. Other embodiments comprise an aqueous dispersion of the admixture, a pressure-sensitive recording manifold and methods of making the dispersion.

12 Claims, No Drawings

COLOR DEVELOPING COMPOSITION FOR CARBONLESS PAPER COPYING SYSTEM

FIELD OF THE INVENTION

The invention relates to color developers used to develop images in pressure-sensitive carbonless paper recording systems. More specifically, the invention relates to a color developer composition comprising an admixture of calcium carbonate and a bisphenol.

BACKGROUND OF THE INVENTION

Pressure-sensitive carbonless paper recording systems have evolved into a very large market, chiefly due to their convenience compared with carbon paper copying. A review of the state of the carbonless paper art is Petitpierre, "DYES AND CHEMICALS FOR CARBONLESS COPYING PAPER: HISTORY, PRESENT SITUATION, PROBLEMS AND TRENDS", 1983 Coating Conference, TAPPI PROCEEDINGS, p. 157–165, herein incorporated by reference. As described therein, carbonless paper involves a manifold comprising a matched pair of paper sheets termed a donating paper and a receiving paper. When written upon, the donor paper is pressed into contact with the receiver paper, and an image substantially identical to the writing develops on the receiver paper.

This image development is brought about by the contact of a colorless dye precursor or color former contained on the donor paper with a color developer contained on the receiver paper. Generally, a solution of the color former in a solvent is encapsulated in microcapsules and coated on the back side (CB) of the donor paper, which has an uncoated front or top side. The color formers, often termed "leuco dyes", are, for example, triphenyl methanes (such as Crystal Violet Lactone), xanthenes (such as N-102 flouran), and thiazines (such as Benzoyl Leuco Methylene Blue). The color developer is generally coated on the front side (CF) of the receiving paper. When the CB and CF sheets are placed in contiguous relationship and pressure, such as from a writing instrument or typewriter, is applied, the microcapsules are crushed. The released color former solution is then adsorbed onto the CF sheet, where it contacts the color developer. The image on the CF sheet develops from a chemical transformation of the color former to a colored form caused by the color developer. In general, this chemical transformation entails an acid-base type reaction wherein the color former changes from an uncharged, colorless state to a positive charged, colored state.

Alternatively, the color former/microcapsules and color developer can be coated onto the same paper sheet or the developer can be on the CB sheet and the color former/microcapsules can be on the CF sheet. For convenience hereafter, "CB sheet" refers to a paper sheet coated with the color former solution in microcapsules, and "CF sheet" refers to a paper sheet coated with a color developer. In addition, the manifold assembly of paired CB and CF sheets can include more than one pair of sheets.

Currently, two types of color developers are in wide use. Phenolic resins are polymeric long-chain compounds, which are generally of high molecular weight resulting from the polymerization of formaldehyde and a biphenol compound. Their use has several drawbacks, however. For example, they must be subjected to a long and complicated milling process to produce a resin of a specific particle size suitable for use in carbonless paper. In addition, the resins can decompose, releasing toxic formaldehyde. Next, the resins give a yellowish background to the CF sheet resulting in a higher image background for the writing image, which is accordingly of lower quality. Finally, the phenolic resins do not develop high image densities because the resins are of limited solubility in the color former solution again resulting in low image quality.

A second type of color developer is an acid-treated clay which has its own drawbacks. First, preparation of the clay requires careful treatment with a strong mineral acid because the color developing activity of an acid clay depends on the extent of hydrogen ion exchange into the clay to form color developing sites on the clay surface. In addition, a highly porous clay surface is necessary to ensure a good quality image which requires sufficient contact between the color former solution and the color developing sites on the clay surface. This problem of contact between the color former and acid clay is similar to the limited solubility of phenolic resins in the color former solution. Hence, image quality is highly sensitive to the chemistry and morphology of an acid clay, yet these parameters are very difficult to control.

In addition, CF sheets are prepared by coating a slurry of the color developer and an adhesive onto paper and letting the coating dry. The coating slurry is known in the art as a coating color. High solids concentrations, which includes solids content of the developer and the adhesive, in the coating color are desirable for good image quality, but concentrations above 45–50 weight % are generally unattainable with phenolic resins or acid clays due to the poor rheology, caused by high viscosity, of coating colors containing them.

Biphenolic compounds, which have not been polymerized like the phenolic resins, have been disclosed as color developers for certain lactone-type color formers in U.S. Pat. No. 3,244,550, "Manifold Sheets Coated with Lactone and Related Chromogenous Compounds and Reactive Phenolics and Method of Making", Farnham et al., issued Apr. 5, 1966. Farnham also discloses that "neutral or inert" pigments serve to make the coating containing the color developer whiter and more opaque. The pigments disclosed are titanium dioxide, zinc oxide, zinc sulfide or zirconium dioxide, which are all known as "hiding pigments" in the coating art, and have high refractive indexes of 2.0 to 2.7. Farnham does not disclose a non-hiding pigment such as calcium carbonate which has a refractive index of about 1.5. Next, Farnham uses an amount of pigment of about 1/10 of the coating weight on a dry basis. Farnham states the pigment has "no noticeable effect" on image development. Farnham also uses a large amount, at least 10 weight %, of the biphenol in the CF coating, and in the only operative example, the amount of phenol is 35 parts and the amount of pigment is 4 parts in a 100 part coating color.

U.S. Pat. No. 3,450,553, "Pressure Sensitive Record Material", Billet et al., issued June 17, 1969, discloses lignin as the color former in carbonless paper, and two specific phenols, phloroglucinol and 3-hydroxy phenyl urea, as color developers for lignin.

U.S. Pat. No. 4,349,218, "Copying Material Employing Flouran Color Formers", Garner, issued Sept. 14, 1982, also discloses phenolic color developers for flourans, such as 4-t-butylphenol, 4-phenylphenol, 2,2'- dihydroxydiphenyl, 4,4'-isopropylidenediphenol (Bisphenol A), and 4,4'-isopropyliden-bis-(2-methylphenol). Garner does not disclose a phenol admixed with a pigment such as calcium carbonate.

Gr. Britain Pat. No. 1,356,402, "Colour Developer Sheet for Pressure Sensitive Recording", issued June 12, 1974 discloses a color developer of "one or more clays capable of acting as color developers" and at least one monomeric phenolic compound. The amount of phenolic compound is about 1 to 10 parts by weight per 100 parts of clay. The clays listed are "attapulgite, acid clay, active clay, zeolite and bentonite." These clays are either the acid treated clays discussed above or certain smectite clays which are known as active color developers without acid treatment.

U.S. Pat. No. 4,046,941, "Support Sheet with Sensitized oating of Organic Acid substance and Organic High Molecular Compound Particulate Mixture", Saito, issued Sept. 6, 1977, discloses a two component color developer mixture of an aromatic carboxylic acid or its metal salt with an organic high molecular compound. The aromatic carboxylic acids disclosed include certain hydroxy carboxylic acids such as salicylic acid. The organic high molecular compound has a molecular weight above 400, such as polybutadiene, and must be compatible, i.e., miscible, with the aromatic acid. The amount of high molecular compound must also be enough to give the composition the desired resistance to heat, light and moisture. In one aspect, the mixture is adsorbed around an inorganic powder such as clay or calcium carbonate. Although Saito does disclose an admixture of $CaCO_3$ and color developer, Saito's color developer must contain both the carboxylic acid compound and the high molecular compound. Moreover, the high molecular compound in the color developer presents the same drawbacks as phenolic resins.

U.S. Pat. No. 4,416,471, "Color-Developing Sheet for Pressure Sensitive Recording Sheet," Yamato, issued Nov. 22, 1983, discloses a color developing sheet with a layer of an organic color developer, calcium carbonate and a specific binder, an acrylamide modified polyvinyl alcohol, in an amount of 5–25 weight % to glue the developer and pigment on the sheet. This specific polyvinyl alcohol is critical to Yamato since he discloses that fine particle size calcium carbonate in a coating creates numerous gaps between particles which act as capillaries to adsorb the color former solution, and that this binder does not mask the gaps. Yamato discloses the organic color developer are phenolic resins or their metal salts, or organic acid substances such as a "metal salt of 2,2-bisphenol sulfone." Yamato does not disclose that his color developing sheet can be produced using a coating color of high solids content.

Although not directed to color developers, U.S. Pat. No. 3,894,168, "Paper Coating Pigment Material," Brockett, issued July 8, 1975, discloses a treated pigment color former. Brockett adsorbs a color former such as Crystal Violet Lactone on a pigment such as calcium carbonate to produce a coated pigment particle. However, the Brockett color former is unprotected from being converted to a colored form by, for example, air, the oil from human skin, or the other components in a paper coating.

What is needed is a low-cost, color-developer composition which is capable of developing high quality images. It is an object of Applicants' invention to provide such a composition comprising calcium carbonate. Another object is to use a color developing composition comprising a bisphenol. Another object is to provide a color color developer coating having high solids content. Other objects appear below.

SUMMARY OF THE INVENTION

The invention broadly comprises a composition useful in CF sheets for pressure sensitive recording systems comprising calcium carbonate admixed with a monomeric bisphenol color developer having the general formula:

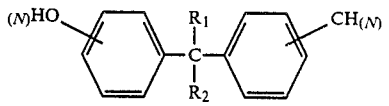

wherein N is 1, 2, 3, 4, or 5, $R_1$ and $R_2$ are the same or different and are H, alkyl, substituted alkyl, amino, or substituted amino. Preferably the ratio of bisphenol to calcium carbonate is about 2 to about 20 parts per 100 parts by weight calcium carbonate. The composition is an effective color developer for any color former converted to a colored form by an acid-base type reaction. Significantly, the admixture of calcium carbonate and bisphenol shows a synergistic increase in intensity of images developed with the admixture.

In one embodiment, the invention comprises a high solids content aqueous dispersion of calcium carbonate, the bisphenol, and a pigment dispersant, which is used to formulate a coating color for CF sheets. Another embodiment comprises a carbonless paper manifold comprising a CF sheet coated with the composition and a CB sheet comprising a leuco dye dissolved in a $C_4$–$C_{12}$ alcohol in which the bisphenol is soluble. Finally, the invention comprises methods for making the novel compositions of the invention. A preferred method is to wet grind an aqueous slurry comprising the pigment and the color developer compound to produce the aqueous dispersion having a pigment particle size below about 5 $\mu$m.

CF sheets comprising the composition develop high quality images with good image density. In addition, the composition can be formulated in a high solids content coating color which results in faster coating and drying, thereby enhancing the paper quality and throughput.

DETAILED DESCRIPTION OF THE INVENTION

The invention comprises a color developing composition comprising a monomeric phenol color developer compound adsorbed onto or admixed with an alkaline earth carbonate such as calcium carbonate. The monomeric phenol has the general formula shown above and is herein termed a bisphenol. The relative amounts by weight of bisphenol and $CaCO_3$ used are about 2 to about 20 parts bisphenol per 100 parts of $CaCO_3$. The composition of the invention can be made by adsorbing the phenol onto $CaCO_3$ or admixing the phenol and $CaCO_3$. As used herein, the term "admixed with" refers to either an adsorbed composition or an admixed composition of phenol and $CaCO_3$.

A color developer dispersion comprising an aqueous dispersion of the pigment and bisphenol which is used to make the CF coating color comprises one embodiment of the invention. In another embodiment, the invention comprises a coating color comprising the phenol/$CaCO_3$ admixture. In another embodiment, the invention comprises a CF sheet coated with the color developing composition. Another embodiment comprises a carbonless paper manifold assembly using a CF sheet coated with the composition. The CB sheet used in such a manifold preferably comprises a leuco dye color former dissolved in a solvent comprising an alcohol of carbon number 6 to 12, since the bisphenol is soluble in these alcohols. Other embodiments comprise methods for making the color developing composition, all of which employ a separate admixture step of mixing the monomeric bisphenol and calcium carbonate before formulating the coating color.

As seen in the Examples, the bisphenol/calcium carbonate admixture of the invention when used in a CF sheet surprisingly and synergistically improves the quality of the image developed. Without wishing to be bound by theory, Applicants consider that the synergistic increase from admixtures of $CaCO_3$ and a bisphenol of Formula I is due to enhanced polarization of the bisphenol caused by the $CaCO_3$ when the color former solution contacts the CF sheet, thereby rendering the bisphenol more acidic and thus more active.

An important advantage of the invention is that the phenol and calcium carbonate admixture can be used in a CF coating color having good rheological properties and a solids content of about 50 to about 75 weight %, and preferably about 55 to about 65 weight %. This solids content includes the phenol, the $CaCO_3$, and the binder solids. Such high solids content has not been used in carbonless paper coating colors, improves paper quality, and speeds up coating, drying and production at lower cost, since equipment utilization is increased. Another advantage of the invention is that the phenol is evenly admixed with the pigment so that an even distribution of the color developer on the CF paper results. Yet another advantage is that the monomeric bisphenol can be a low cost phenol such as Bisphenol A. A further advantage is that calcium carbonate is readily-available at low cost and is an established paper filler. $CaCO_3$ also prevents yellowing of the CF sheets. Another significant advantage is that the color developer composition can be formulated as a stable aqueous dispersion which can thus be transported easily from a pigment mine site to a paper mill.

The calcium carbonate used in the invention in general is finely milled and is preferably white or colorless to enhance the contrast of the image developed on the receiving paper. Colored or dyed $CaCO_3$ can be used, but since their use can reduce image contrast due to display against a colored pigment background, the color former used with dyed $CaCO_3$ must be carefully chosen. Any form of calcium carbonate, such as precipitated calcium carbonate or aragonite, can be used. The advantages of calcium carbonate in the invention comprise making the coated paper basic, thereby prolonging the paper's shelf life. In addition, calcium carbonate has a bright white color and hence increases image contrast. Finally and most important, as seen in the examples, $CaCO_3$ has a synergistic improvement on image density when used with a bisphenol of the above formula.

The particle size of the $CaCO_3$ can be of any distribution, but preferably correspond to the particle sizes of pigments conventionally used in paper coating colors. For the CF sheets the $CaCO_3$ is preferably substantially all smaller than 4 $\mu$m because the CF coating should be less than 5 $\mu$m thick. This 4 $\mu$m top size is preferred because coarser sizes can cause an uneven coating surface on the CF sheet or cause "blue streaks" after paired with CB sheets by premature rupture of the CB microcapsules. The amounts of the $CaCO_3$ used in the composition are discussed below in conjunction with the method of making the composition. Finally, the $CaCO_3$ does not require any special pretreatment, such as, for example, to improve porosity, other than size reduction of the raw pigment.

The monomeric bisphenols admixed with $CaCO_3$ are Lewis acids which function by accepting/extracting an electron from the color former thereby chemically converting the color former into a highly-colored ionic form. As is developed below, bisphenols of the following Formula I admixed with $CaCO_3$ have good reactivity and show synergistic improvement in image density.

The monomeric bisphenols used have the general formula:

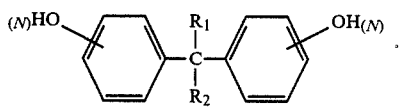

Formula I

Formula I indicates that the phenolic OH groups can be located at any of the free positions, 2–6 and 2′–6′ counting from the shared carbon atom (C in Formula I) between the benzene rings. N is 1, 2, 3, 4, or 5 and indicates at least one OH group is on each benzene ring. Bisphenols containing a total of at least two OH groups are used because phenols containing a single OH groups are not sufficiently reactive to develop good density when used with $CaCO_3$ in CF sheets. Particularly preferred are bisphenols with only one OH moiety on each benzene ring located at the 4 and 4′ (para or para′) positions to the shared carbon atom, because this type of bisphenol develops high optical densities. $R_1$ and $R_2$ in Formula I can be the same or different and can be hydrogen; alkyl, such as —$CH_2$—, —$CH_2CH_3$, isopropyl, or longer chain alkyl groups; substituted alkyls; amino; or substituted amino. Hydrogen or alkyl up to $C_3$ are preferred for $R_1$ and $R_2$ because of cost. Although not shown in Formula I, the aromatic rings can be substituted by substituents, preferably other than carboxylic acids, such as alkyl, phenyl, halo, nitro, amino, sulfate, sulfonate, and sulfite, which do not make ineffective the color developing capability of the phenol when mixed with $CaCO_3$. In this regard, some constituents, such as alkyl groups, or those located immediately next to the OH group can reduce the OH's acidity. Halogen substituted bisphenols are not preferred because of toxicity and cost problems. Particularly preferred bisphenols are alkylidenediphenols wherein $R_1$ and $R_2$ are hydrogen or alkyl, such as 4,4′-methylidenediphenol, 2,4′-methylidenediphenol, 4,4′-secbutylidenediphenol and 4,4′-isopropylidenediphenol (Bisphenol A) The most preferred bisphenol is Bisphenol A ($R_1$ and $R_2$ = methyl, and single OH groups at the para positions in Formula I), because of the high quality carbonless paper image produced by Bisphenol A and $CaCO_3$ and because of its ready availability and lower cost. Bisphenol A is also known as 2,2-bis(p-hydroxyphenyl) propane.

A CF sheet coated on one side with the color developing composition comprises another embodiment of the invention and a copying manifold employing this CF sheet comprises another embodiment. Before describing the CF sheet in greater detail, the other components of the manifold are discussed.

The manifold preferably comprises at least one CB sheet uncoated on its front and coated on its back with the microencapsulated color former and at least one CF sheet coated on its front with the color developing composition, wherein the CF and CB sheets are always in contiguous relationship. Other arrangements of the encapsulated color formers and the color developing composition of the invention, noted above, can be used if desired. For example, the color developing composition and the microcapsules containing the color former can each be coated onto the same paper sheet. The claims are intended to cover all possible arrangements of the manifold. More than a two sheet manifold can also be produced. In this embodiment of the invention, the CF sheet comprising the color developing composition is coated on its back (CB) with the color former/-microcapsules. Another CF sheet is placed below the CF/CB sheet. The manifold thus can be made to contain as many sheets as desirable, but at some point the manifold is too thick to transmit writing pressure to the bottom sheets.

The color formers which are activated by the color-developing composition generally comprise any colorless chromogenic leuco dye which can be used in a carbonless paper manifold, but do not comprise chelating agents which function as color formers by chelation of a metal atom. The color former must be capable of transformation by the color developer of the invention from a colorless form into a colored form. For example, Petitpierre, discussed above, lists several color formers, such as, Crystal Violet Lactone, described in U.S. Pat. No. 2,417,897, and flouran N-102, described in U.S. Pat. No. 3,681,390. Suitable color formers comprise, for example, Pyridyl Blue, which is an isomeric mixture of 7-(1-ethyl-2-methylindol-3-yl)-7-(4-diethylamino-2-ethoxyphenyl)-5,7-dihydrofuro[3,4-b]pyridin-5-one; and 5-(1-ethyl-2-methylindol-3-yl)-5-(4-diethylamino-2-ethoxyphenyl)-5,7-dihydrofuro[3,4-b]pyridin-7-one; Benzoyl Leuco Methylene Blue (BLMB), which is 3,7-bis (dimethylamino)-10-benzoyl-phenothiazine; Crystal Violet Lactone (CVL), which is 3,3-bis(4-dimethylaminophenyl)-6-dimethylaminophthalide; flouran N-102, which is 2'-anilino-6'-diethylamino-3'-methylfluoran; Indolyl Red, which is 3,3-bis(1-ethyl-2-methylindol-3-yl)phthalide; 3,3-bis(1-butyl-2-methylindol-3-yl)phthalide; spiro-7-chloro-2,6-dimethyl-3-ethylaminoxanthene-9,2-(2H)napththol [1,8-bc]furan; 7-chloro-6-methyl-3-diethylaminofluoran; 3-diethylamino-benzo[b]fluoran; 3-(4-diethylamino-2-ethoxy)-3-(2-methyl-1-ethylindol-3-y-1) phthalide; 3-(4-diethylamino-2-butoxy)-3-(2-methyl-1-ethylindol-3-yl)phthalide; and 3,7-bis(diethylamino)-10-benzoylbenzocazine. Mixtures of color formers can also be used if desirable. A more extensive listing of useful color formers is not believed necessary because useful ones are well known to those skilled in the art.

The color former determines the color of the developed image. For example, Crystal Violet Lactone, Benzoyl Leuco Methylene Blue, and Carbazoyl Blue develop blue images; Bisindoylphthaladide, monoaminoflouran and diaminoflouran develop red images; and flouran (N-102) develops a green-gray image. A black image develops from a mixture of flouran (N-102), Crystal Violet Lactone, Benzoyl Leuco Methylene Blue, and monoaminoflouran, and this mixture is a preferred color former.

As is known in the art, the color former is dissolved in a solvent system. The weight % of the color former in the solution varies with the particular color former and the fluids making up the solvent system but is generally within about 0.5% to about 10% by weight, preferably about 1% to about 5%.

The solvent system for the color former comprises a transfer fluid and optionally a diluent and is an important factor of the invention. To permit microencapsulation, the solvent system is water immiscible and inert towards the encapsulation catalysts and must dissolve the color former. The solvent is preferably substantially odorless for use in an office environment. The solvent also has a boiling point within about 160° to about 325° C. to produce faster evaporation after breaking of the microcapsules while lessening evaporation through the uncrushed capsules.

Since the image-forming reaction occurs only after contact with the developer, the solvent must also dissolve the bisphenols of the invention. Thus any solvent system known in the art which dissolves the bisphenols of Formula I can be used. U.S. Pat. No. 4,275,905 lists conventional organic transfer fluids and diluents. It should be noted that the solid bisphenols used may not be soluble to a large extent in the chlorinated biphenyls and napthalene solvents conventionally used. However, Applicants prefer that the solvent has a solubility for the bisphenol of greater than about 0.2 gr/10 cc of solvent, and for example, 2,6-dimethyl naphthalene with a solubility for Bisphenol A of about 0.2 gr/10 cc can be used.

Preferred transfer fluids believed to have sufficient solubility for the bisphenols are ketones having at least 6 carbon atoms, including alkyl, aromatic and cycloketones, such as 4-methyl-2-pentanone, 2,6-dimethyl-4-heptanone, methyl isoamyl ketone, cyclohexanone, diisobutyl ketone, acetophenone, 2-octanone, isophorone, 2-heptanone, 3,3-dimethyl-2-butanone, and 1,3-diphenyl-2-propanone; ethers having at least 4 carbon atoms, including alkyl and aromatic ethers, such as benzyl ether, 2-ethoxy ethyl ether, phenyl ether, 1,2-dimethoxyethane, 2-methoxy ethyl ether; esters having at least 7 carbon atoms, such as amyl acetate, benzyl acetate, butyl benzyl phthalate, pentyl acetate, butyl octyl phthalate, butyl oleate, dibutyl phthalate, 2-ethyl-hexylacetate, butyl stearate, diisobutyl phthalate, di-isodecyl phthalate, dibutyl maleate, and 2-ethoxy ethyl butyrate; and alcohols having 4 to 12 carbon atoms, such as n-butanol, n-pentanol, n-hexanol, n-octanol, n-decanol, and benzyl alcohol. Alcohols with carbon numbers above 12 do not permit sufficient image development while carbon numbers below 4 are water miscible. Alcohols are most preferred as the transfer fluid since their use leads to high optical density and stable images. More preferred alcohols are linear alcohols having a carbon number of 6–9 because they readily dissolve the most preferred Bisphenol A and linear alcohols are less odorous than branched chain ones.

A CB sheet comprising a microencapsulated colorless, leuco dye dissolved in an alcohol of 4 to 12 carbon atoms is another embodiment of the invention, and Applicants are not aware of these alcohols' use in connection with leuco dye color formers. However, alcohols are disclosed in U.S. Pat. No. 3,592,677, Tsuboi, issued July 13, 1971, and Gr. Britain Pat. No. 1,492,713, issued Nov. 23, 1977, as solvents for chelating agent color formers which convert to a colored compound by chelating a metal such as vanadium contained on the CF sheet.

It is also possible, however, that some transfer fluids can interfere with the polymerization catalyst used in the microcapsule formation. For example, some alcohols can interfere with di-isocyanate derivative catalysts. Thus, the transfer fluid and the type of microcapsules used must be compatible.

The transfer fluids can be used alone or in various mixtures, and/or in mixtures with diluents. Diluents include high-boiling straight and branched-chain hydrocarbons. The diluents are used to decrease the cost of the solvent system. A preferred diluent is a mixture of saturated aliphatic hydrocarbon oils having a distillation temperature of 160° C. to 260° C. Other diluents which can be employed include internal phase solvents known in the art, provided that they are not halogenated, are at least partially miscible with the transfer fluid so as to give a single phase in the proportions used, and are not chemically reactive with the transfer fluid, the other components of the color former solution, or the microcapsule components. The weight ratio of diluent to transfer fluid can be of any value, but in all solvent systems the amount of transfer fluid must be sufficient to dissolve the amount of color former used. To minimize cost the amount of transfer fluid is minimized, and a typical solvent system comprises, for example, 4 parts by weight diluent and one part transfer fluid. The solvent system can also comprise additives to alter or control the final properties of the system such as viscosity control agents, vapor pressure control agents, freezing point depressants, odor masking agents, antioxidants, or colored dyes.

The color former solution is contained in microcapsules. The microcapsules can be prepared by any method known in the art such as from gelatin as disclosed in U.S. Pat. Nos. 2,800,457 and 3,041,289, from a urea-formaldehyde resin as disclosed in U.S. Pat. Nos. 3,516,846, 4,001,140, 4,087,376 and 4,089,802 or from various melamine-formaldehyde resins as disclosed in U.S. Pat. No. 4,100,103. As known in the art, the microcapsule formulation used depends on the solvent for the color former because certain solvents can diffuse through some types of microcapsule shells. Urea-formaldehyde polymers are preferred for use with solvents comprising an alcohol.

Any binder or pigment adhesive for the microcapsule coating on the CB sheet and the color developing composition coating on the on the CF sheet can be used. Suitable binders comprise water soluble binders such as starch, carboxymethyl cellulose, polyvinyl alcohol, gelatin, gum arabic, or dextrine; latexes such as polyvinyl acetate, butadiene-styrene copolymer, or polyacrylic, or any mixtures thereof. A preferred binder for the CF sheet is butadiene-styrene copolymer latex. The amounts of binder are discussed below.

Formulations and techniques for the preparation of the carbonless copy sheets per se are well known in the art, for example, as disclosed in U.S. Pat. Nos. 3,627,581, 3,775,424 and 3,853,869.

The methods of preparing the color developing composition, a CF coating color comprising the composition, and the CF sheet comprising the composition are now described in more detail. It should be noted that the color developing composition is formulated in a liquid slurry or suspension, which can be dried to produce a powdered composition. For purposes herein, the term "color developer dispersion" refers to the liquid slurry or suspension of the color developing composition. The powdered color developing composition can be redispersed to produce the color developer dispersion. These dispersions are used to produce the CF coating color which is eventually coated onto paper and dried to produce the CF sheets comprising the color developer composition of the invention. The color developer dispersion is an important aspect of the invention because it can be formulated at a $CaCO_3$ mine or production site and then shipped to a paper mill.

As noted previously, preparation of the color developer dispersion involves mixing the bisphenol and $CaCO_3$, preferably prior to formulation of the coating color. It is preferred to first formulate the dispersion since this facilitates even mixing of the bisphenol and $CaCO_3$. The preferred method of making the color developing composition comprises forming an aqueous feed slurry or suspension comprising the bisphenol, $CaCO_3$, a dispersant, and a protective colloid, and wet grinding the feed slurry to produce the color developer dispersion comprising the color developing admixture.

In this preferred method, the $CaCO_3$ content in the feed slurry is preferably as high as possible to cut grinding cost. Thus, although lesser amounts can be used, $CaCO_3$ preferably comprises within about 50% to about 85% by weight of the feed slurry, since lesser amounts cause undue wear on the grinding mill and greater amounts agglomerate and prevent grinding. A more preferred range is about 70 to 75 weight % $CaCO_3$ since such feed slurries can be processed in one pass through a mill. The dispersants are conventional solid grinding dispersants, can be any suitable type such as an anionic ammonium polyacrylate, a nonionic polyethylene oxide condensate, or polycarboxylic acid salts, and are added in an amount sufficient to disperse, i. e., avoid agglomerating, the $CaCO_3$. Such an amount preferably comprises about 5 to about 25 lbs. per ton of pigment.

The amount of bisphenol in the feed slurry comprises any amount sufficient to develop acceptable optical densities above about 0.40, and preferably above about 0.50, and is generally about 2.0 to about 20 weight % of the $CaCO_3$. A preferred range is about 4.0 to about 10.0 weight % of the amount of $CaCO_3$ because above this range the minimal increases in image optical density do not offset the increased cost. A more preferred range is about 4.0 to about 8.0 weight % of the $CaCO_3$ since these amounts develop high optical density. These preferred weight ranges of bisphenol are an advantage of the invention because of decreased cost. For instance, the Farnham patent discussed above shows use of 35 weight percent of a biphenol compound in the coating color.

A protective colloid is added to the feed slurry in an amount effective to prevent flocculation of the bisphenol, which is about 0.1 to about 1.0 wt. % of the $CaCO_3$ 3, more preferably about 0.2 to about 0.4 weight % of the $CaCO_3$. The protective colloid comprises, for example, polyvinyl alcohol or carboxymethylcellulose, prevents poor rheology due to agglomeration of the phenol and pigment, and thus stabilizes the produced dispersion leading to a more uniform CF sheet and better optical density. The colloid does not convert the color former to a colored form in a carbonless paper system. The protective colloid can also be added to the color developer dispersion after the grinding but is preferably added to the grinding feed slurry because its presence can increase grinding rate.

Polyvinyl alcohol is the preferred protective colloid because of lower viscosity in dispersions using it, and is typically prepared by hydrolysis of polyvinyl acetate.

Any polyvinyl alcohol polymer can be used, and suitable polyvinyl alcohol polymers are hydrolyzed to an extent from about 85 to about 91 percent, and have molecular weights such that a 4% solids solutions of the polyvinyl alcohol in water has a viscosity of from about 4 to about 25 centipoises at 25° C. Suitable polyvinyl alcohols are available from Air Products and Chemicals, Inc. under the tradename VINOL ®, and these are not acrylamide-modified as in the Yamato patent. It should be noted that the polyvinyl alcohol is often used as a coating binder, but in much larger amounts than above.

The aqueous feed slurry comprising the phenol, $CaCO_3$, dispersant and protective colloid can be predispersed by mixing for a short period if desired, and at ambient temperature is passed through any suitable grinding mill, such as a Netzsch or media mill, or other suitable particle comminution apparatus. In the grinding mill, the color developer compound is admixed with the $CaCO_3$ and all solids are reduced in size to the preferred 4 μm top size. Some heating occurs during grinding, generally to less than about 85° C., and this heating can cause a portion of the solid phenol to be adsorbed onto $CaCO_3$. The grinding time period varies with the milling device but is generally a time sufficient to reach 4μ top size. Multiple passes can be necessary depending on the mill and the initial size of the $CaCO_3$ and solid bisphenol used. To aid the grinding rate, the bisphenol can be milled before addition to the feed slurry. The resulting color developer dispersion comprises the color developing composition and is ready for making the CF coating color.

The coating color is produced by adding to the color developer dispersion the adhesive binder, additional dispersion agent, an antibacterial agent (if desired), an antifoaming agent, and antioxidant to protect the bisphenol. It is preferred that the amount of adhesive binder added on a dry solids basis is about 5 to about 30 parts per 100 parts of $CaCO_3$ and bisphenol solids, because below 5 parts, the binder is insufficient to affix the $CaCO_3$ and phenol to the paper and above 30 parts interferes with image development. Preferably, the amount of binder is about 5 to about 15 parts per 100 parts solids, which is an advantageous low binder pigment ratio. Conventional antifoaming agent, such as fatty acid esters, or petroleum distillates, is added in an amount of about 0.1–0.5 parts per 100 parts by weight bisphenol since larger amounts can cause agglomeration. The dispersant agent is added as needed if an extender pigment such as coating clay is added. The coating color is mixed until uniform to produce the coating color comprising the color developer composition of the invention.

The coating colors comprising $CaCO_3$ and the solid bisphenol according to the invention preferably have a total solids content ($CaCO_3$, bisphenol, and other solids such as the binder) of about 50 to about 75 weight % of the color, although lesser amounts can be used, and more preferably about 55 to about 65 wt. % of the color. These preferred ranges are based on the desired rheology for coating colors. The critical feature for coating rheology is that the color must be fluid enough at high shear rates to be coated. Because paper coating machines operate at shear rates about 50,000 sec.$^{-1}$, color viscosity at 10,000 sec.$^{-1}$ is measured. The coating colors of the invention within the range of 50–75% total solids showed excellent high shear viscosity well below about 1.5 poise. The examples list some of the test data. The more preferred range of 55 to 65 wt % was chosen because below this range the color can be too thin at high shear rate for proper coating, thus requiring addition of a viscosity builder, and above this range the color can be too thick or pasty at low shear rate, thus leading to mixing and pumping problems. Applicants consider the high solids colors containing the bisphenol and $CaCo_3$ very significant, because the bisphenol does not appear to affect the rheology to any significant degree. The high solids colors are also preferable because they save energy by reducing coating drying time and they increase coating machine throughput.

The wt. % of calcium carbonate in the coating color is preferably above about 30 wt. % on a dry solids basis, and more preferably above about 50 wt. %, to ensure good polarization of the bisphenol and thus good image density. In general, use of greater amounts of the bisphenol permits some decrease in $CaCO_3$. Calcium carbonate above 50 wt. % is more preferred since it yields high image density with 5 % Bisphenol A.

Supplementary fillers and extenders can be added to the coating color to improve adsorption of the color former solution by the CF sheet. These fillers can be used in an amount up to about 50 weight % of the $CaCO_3$. Useful fillers include coater kaolin, talc, silica, and the like.

To produce the CF sheets, the coating color is coated onto a support such as plastic or paper sheets and allowed to dry. The paper used can be any desired paper product. Any technique for coating the slurry onto the paper can be used, and such techniques are known in the paper art. For example, roll coating, air-doctor coating, blade coating, or cast coating can all be used. Blade coaters are particularly preferred for high-solids content coating slurries and thus find particularly desirable use with the coating slurries of the invention. The paper is dried to evaporate liquid from the coating to yield any suitable coating density which preferably comprises within the range of about 4 to about 10, and more preferably about 6 to about 8, grams per square meter. Coating weights of at least 4 g/m$^2$ are preferable with above 8 wt. % bisphenol, and at least 6 g/m$^2$ are preferable with below 8 wt. % bisphenol colors.

The produced CF sheets are paired with CB sheets containing the microencapsulated color former as described above. The carbonless paper system of the invention comprising the CF sheet with the color developing composition is then ready for use.

In another less preferred preparation method, the color developing composition is prepared by dissolving the bisphenol in a water miscible, adsorbing solvent to produce a color developer solution which is mixed, such as by spray coating, with the $CaCO_3$. This method is less preferred because of additional solvent costs.

Useful adsorbing solvents include water and lower molecular weight organic solvents of carbon number 5 or less such as alcohols, acetates, and ketones. Although it is possible to use water as the adsorbing solvent for the phenol, some phenols are not soluble to an appreciable extent in water, therefore necessitating an organic solvent in which adsorption occurs. It is thus preferred to use an organic solvent to dissolve the bisphenol, and isopropyl alcohol is a suitable solvent.

The amount of adsorbing solvent used is generally an amount sufficient to dissolve the desired quantity of phenol, which is the same as that used in the grinding method. The exact amount of solvent also depends on whether a powdered composition is to be prepared.

Where the powder is desired, only an amount of solvent sufficient to dissolve the bisphenol is added. Where a coating color is to be made after the adsorption directly from the color developer dispersion, the amount of solvent is determined by the desired weight percent of solids in the coating color. It is here preferred that the amount of solvent used is in the range of about 5 to about 25 percent, and more preferred about 10 percent, by weight of the coating slurry. For example, in a coating color comprising 1 gram of the phenol adsorbed onto 14 grams of pigment, 7 grams of binder, and 28 milliliters of water, 28 milliliters of isopropyl alcohol are used, which is about 25 weight percent of the coating color.

The color developer solution is mixed with the pigment for a period of time sufficient for adsorption of the bisphenol onto the $CaCO_3$ to occur. The adsorption is believed rapid and, for example, a slurry of the color developer solution and $CaCO_3$ is mixed for a period of time in excess of about 1 minute and preferably for about ½ hour.

Water is then added to form the color developer dispersion. The amount of water added depends on whether the dispersion is used directly to make the coating color. Where the coating color is prepared directly, enough water is added to produce the desired solids content by weight in the coating color For example, 0.7 grams of Bisphenol A in 37 milliliters IPA was added to 14 grams calcium carbonate; fifty-two milliliters of water was then added to produce the dispersion; 7.6 grams of adhesive latex binder, which was 50 percent solids by weight, was then added to produce a 20 weight percent solids coating slurry. Where the dispersion is instead to be dried to produce a powder color developer composition, sufficient water is added to disperse the slurry. This amount is typically an amount equivalent to the amount of solvent used to dissolve the color developer compound.

Production of the powder involves evaporation of the organic solvent and/or water contained in the dispersion. The drying can be performed in any desired manner. For example, a dispersion of water, isopropyl alcohol, and adsorbed color developer composition are run through a spray dryer and then dried at 87° C. for approximately 10 hours.

To generate the color developer dispersion from the dry powder, sufficient water, dispersant, and preferably protective colloid, to produce the desired weight percent solids in the coating color, as described above, is added. The adsorbing solvent can also be added along with the water in the dispersion of the dry powder, but this is not preferred because of cost. If added, the amount of alcohol is about 5 to about 25 weight percent of the coating color.

The following examples are presented to illustrate the invention.

EXAMPLES 1–4

Examples 1 through 4 determined the background color developing property of the pigments, $CaCO_3$, talc, a Montana chlorite, and a kaolinite clay from Aiken, S.C. In each example, a coating color comprising about 30 weight % pigment and sufficient binder was coated on paper and dried to produce CF sheets. Each CF sheet was then paired with commercially available CB sheets from Appleton (A, blue image), Nashua Black (NB, black image), and Boise Cascade (BC, blue image) to form a manifold. Sixty pounds per linear inch pressure was applied by passing the manifold through rollers, and the resulting image density on the CF sheet was measured by densitometer at 500 nm. Table I lists the pigments and optical densities. Surface areas and average particle sizes of the pigments were $CaCO_3$—7 $m^2/g$, 0.65 μm; chlorite—11 $m^2/g$, 1.7 μm; clay—15 $m^2/g$., 0.4 μm; and talc—15 $m^2/g$, 2 μm.

TABLE I

| EXAMPLE | PIGMENT | OPTICAL DENSITY A | NB | BC |
|---|---|---|---|---|
| 1 | $CaCO_3$ | 0.11 | 0.14 | 0.10 |
| 2 | Chlorite | 0.24 | 0.23 | 0.13 |
| 3 | Clay | 0.24 | 0.25 | 0.18 |
| 4 | Talc | 0.23 | 0.24 | 0.20 |

As seen, none of the pigments produced optical densities above 0.25, and Example 1 with $CaCO_3$ produced the lowest optical density with all three CB sheets. All of these pigments thus cannot ordinarily be used as a color developer.

Unless otherwise noted the experimental procedure for Examples 5–27 was as follows: a phenol was dissolved in isopropyl alcohol (15 ml.) and mixed with an inorganic pigment (14.0 gr.) of Examples 1–4 for about ½ hour. No pigment was added in Example 5. Water (21 ml.) was then added to form the color developer dispersion. To the dispersion was added Dow 670 styrene butadiene latex adhesive binder (7.6 gr. per 14.0 gr. pigment; 50% solid by wt.) a dispersant agent (0005 gr.), an antibacterial agent (0.05 gr.), and an antifoamer agent (0.05 gr.), and the resulting coating color was stirred until uniform. The coating color was coated on a paper substrate using a No. 5 or No. 6 wire wrapped rod, and the coated paper was allowed to air dry. The produced CF sheet was placed in contact with a commercially available CB sheet, for example, Nashua (black image former) or Appleton (blue image former). Pressure was applied to the produced manifold by passing them through a pair of rollers set at 60 pounds per linear inch pressure. The density of the image developed on the CF sheet was measured with a densitometer at 500 nm. The measurement error in the image density is considered to be plus or minus 0.05.

Table II lists the details of Examples 5–27, including the color developer compound, pigment, and color former used, the weight percent of color developer and pigment, and the resulting image density.

TABLE II

| Ex. | Color Developer | PIGMENT | Wt. % Col. Dev. | CB Sheet Type | Wt % Pigment In Coating Color | Wt. % Total Solids In Color | O.D. |
|---|---|---|---|---|---|---|---|
| 5 | Bisphenol A | — | 5 | NB | — | — | 0.20 |
| 6 | " | $CaCO_3$ | 10 | NB | 30.7 | 20.0 | 0.70 |
| 7 | " | Clay | 4.8 | NB | 26.0 | 32.0 | 0.47 |
| 8 | " | Chlorite | 4.8 | NB | 26.0 | 32.0 | 0.57 |
| 9 | " | Talc | 4.8 | NB | 26.0 | 32.0 | 0.50 |

TABLE II-continued

| Ex. | Color Developer | PIGMENT | Wt. % Col. Dev. | CB Sheet Type | Wt % Pigment In Coating Color | Wt. % Total Solids In Color | O.D. |
|---|---|---|---|---|---|---|---|
| 10 | " | $CaCO_3$ | 4.8 | NB | 26.0 | 32.0 | 0.58 |
| 11 | " | Clay | 4.8 | A | 25.0 | 33.0 | 0.39 |
| 12 | " | Chlorite | 4.8 | A | 25.0 | 33.0 | 0.45 |
| 13 | " | Talc | 4.8 | A | 25.0 | 33.0 | 0.45 |
| 14 | " | $CaCO_3$ | 4.8 | A | 25.0 | 33.0 | 0.50 |
| 15 | 4-phenylphenol | Clay | 5 | A | 30.8 | 41.7 | 0.30 |
| 16 | 4-pentyl phenol | Clay | 5 | A | 31.0 | 41.7 | 0.30 |
| 17 | pyrogallol | Clay | 5 | A | 31.0 | 41.7 | 0.30 |
| 18 | nonylphenol | Talc | 5 | BC | 31.0 | 41.7 | 0.30 |
| 19 | dodecylphenol | Talc | 5 | BC | 31.0 | 41.7 | 0.30 |
| 20 | o-chlorophenol | Talc | 5 | BC | 31.0 | 41.7 | 0.30 |
| 21 | 4-n-butylphenol | Talc | 5 | BC | 31.0 | 41.7 | 0.30 |
| 22 | octylphenol | Clay | 5 | A | 30.8 | 42.0 | 0.30 |
| 23 | 4-n-dodecylresorcinol | Chlorite | 5 | A | 31.2 | 41.0 | 0.40 |
| 24 | phenol | Talc | 5 | BC | 31.0 | 41.0 | 0.30 |
| 25 | resorcinol | $CaCO_3$ | 5 | A | 26.2 | 32.0 | 0.40 |
| 26 | 4-t-butylcatechol | Talc | 5 | A | 31.0 | 32.0 | 0.40 |
| 27 | phloroglucinol | Talc | 5 | BC | 31.0 | 32.0 | 0.40 |

Examples 5–14 illustrate use of a color developing composition comprising the most preferred bisphenol, Bisphenol A. Examples 1 and 5 illustrate that $CaCO_3$ or Bisphenol A alone are not effective as a color developer in a CF sheet, but that an admixture of Bisphenol A with $CaCO_3$ shows a surprising, synergistic increase in color developing ability. The synergistic improvement of admixing $CaCO_3$ and the bisphenol of Formula I is seen because the optical density developed with Nashua Black and Appleton CB sheets on an additive basis of the phenol and $CaCO_3$ equals 0.34 and 0.31, respectively, but the optical density actually developed by the admixture is 0.58 and 0.51, respectively. This synergistic increase over the additive optical density of Bisphenol A and $CaCO_3$ of 0.24 and 0.19 is greater than any of the increases seen from the phenol admixed with the other pigments, although the other pigments also showed some synergistic increases. However, the synergistic increase with clay with both A and NB paper, and talc and chlorite with A paper could be within the measurement error, while the increases with $CaCO_3$ are clearly outside any measuring error. Note that Examples 10 and 14 in particular, both admixtures with $CaCO_3$, generated optical densities better than commercially available CF sheets.

Examples 6 and 10, taken with another Example, 6′ (duplicating Example 6 except that 14 wt. % Bisphenol A was used), show the preferred wt. % ranges of bisphenol used. Example 6′ at 14 % BPA developed image density of 0.74 compared to Example 6 at 0.70. Thus, increasing the bisphenol content above 10 % had minimal effect. Comparing Example 10 at 4.8 % BPA, O.D. of 0.58 to Example 6's O.D. of 0.70 showed that doubling the amount of phenol did improve image density, but Example 10 developed commercially acceptable densities at lower cost.

Examples 15–27 illustrate that other monomeric polyphenols admixed with pigments are not as effective as a bisphenol of Formula I in CF sheets. Note that Examples 17, 23, 25, 26, and 27 used biphenols different from the preferred bisphenol structure and that none had optical density higher than 0.40. Example 25 of resorcinol (with two OH groups) and $CaCO_3$ is significant since only low density developed. Example 25 indicates the superiority of the bisphenol of Formula I with $CaCO_3$. The single phenols had even poorer image development.

Examples 28–30 were infrared (IR) spectrum analysis run in KBR pellets of $CaCO_3$ (No. 28), Bisphenol A, (BPA) (No. 29) and the color developing composition comprising 8% of the $CaCO_3$ weight BPA admixed with $CaCO_3$ (No. 30). The BPA treated $CaCO_3$ was produced by spray coating a slurry of 8% BPA in isopropyl alcohol and $CaCO_3$. Analysis of the IR spectra showed only a broad absorption over 1000–1800 $cm^{-1}$ and a $CaCO_3$ peak at $2500^{-1}$ for $CaCO_3$ in No. 28 and multiple diagnostic peaks for BPA in No. 29 at about 560, 840, 1180, 1240, 1510, 1600 and 2990 $cm^{-1}$. Number No. 30 also had unobscured peaks attributed to BPA at 560, 840 and 2990 $cm^{-1}$. These examples show that the color developing compound BPA is admixed with $CaCO_3$.

Example 31 illustrates preparation of the dry powder by spray coating. Bisphenol A, 883 gr., was dissolved in 3840 ml. IPA and spray coated onto 15920 gr. $CaCO_3$. The resulting solvent wet powder was dried at 87° C. to produce a white, fluffy powder. This powder has a Bisphenol loading of 5 weight % on the $CaCO_3$.

Examples 32 and 33 were scanning electron microscopic analysis at x1000 magnification of CF sheets coated with 4.8% BPA on $CaCO_3$, No. 32, and 10% BPA on $CaCO_3$, No. 33. The CF sheets were produced according to the procedure for Examples 5–27. Example 33 with 10% BPA showed not as good an admixture as Example 32 since discrete crystals of BPA could be seen, whereas in Example 32 no discrete BPA could be seen. Compared to a commercially available Boise Cascade CF sheet of phenolic resin, the CF coatings in all three appeared less porous.

Examples 34, 35, and 36 illustrate the preferred method of making the color developing composition by wet grinding. An aqueous feed slurry comprising $CaCO_3$ having a particle size distribution of 99% less than 12 μm, Bisphenol A, and sufficient Colloid-230, available from Colloid Co., to be at a dispersant level of 20 lb. per ton of $CaCO_3$ was wet milled starting at ambient temperature in two passes in a 4 liter Netsch mill with ceramic media. Table III shows the details of the feed slurries used to produce color developer dispersions comprising $CaCO_3$ and Bisphenol A. The amount of BPA is % of $CaCO_3$.

About 3 gallons of each dispersion were produced.

TABLE III

| Ex. | Wt. % $CaCO_3$ | Wt. % BPA |
|---|---|---|
| 34 | 70 | 5 |
| 35 | 75 | 5 |

TABLE III-continued

| Ex. | Wt. % $CaCO_3$ | Wt. % BPA |
|---|---|---|
| 36 | 75 | 8 |

The color developer dispersion from Example 36 was studied for slurry stability and aging at 120° F. Table IV shows the results of the stability studies.

TABLE IV

| Time Day | Viscosity (50 rpm) | pH | Conductivity (Ohm/cm) |
|---|---|---|---|
| 0 | 265 cps | 9.76 | 700 |
| 1 | 287 | 9.30 | 622 |
| 2 | 314 | 9.48 | 690 |
| 5 | 388 | 9.69 | 770 |
| 9 | 357 | 9.26 | 780 |

As seen, pH, viscosity, and conductivity do not change with aging. The slight increase in viscosity is normal and expected for $CaCO_3$ slurries. Therefore the dispersion is stable. This is an advantage of the invention because it can be desirable to produce the dispersion at a pigment mill site and then ship the dispersion to a distant paper mill site for production of CF sheets.

Coating colors and CF sheets were then produced from the color developer dispersion of Example 34 to examine optical density development and coating uniformity. To the color developer dispersion was added Dow 670 latex and starch as binders, Tamol®-850 dispersant, and sufficient water to produce various % solid coating slurries. Optionally, Number 2 coating clay from Englehardt Minerals or an amorphous silica (Cab-o-Sil EH-5) as fillers in an amount of 25 parts by weight per 100 parts $CaCO_3$ were added.

For example, a 40% solids coating color was formulated by mixing until uniform 29.4 grams of the 70.4% solids dispersion of 5% BPA, $CaCO_3$ and Colloid 230 at 20 lb./ton $CaCO_3$; 17.9 gr. $H_2O$; 3.0 gram Cab-o-Sil or No. 2 clay; 2.5 gr. Dow 670 latex (50% solids); and 6.25 gr. starch (20% solids). The coating color solid weights and the resulting coating weights were 30% solids and 8 g/m$^2$; 40% and 10 g/m$^2$; 50% and 13.5 g/m$^2$; and 58% and 17 g/m$^2$. The reason some of these coating weights are outside the preferred 4–10 g/m$^2$ coating weight range given above is that the laboratory coating equipment could not efficiently coat these high solids colors. Conventional coating equipment does not have this problem.

The produced CF sheets were then placed in contact with a solution of 2% by weight of solution of a color former mixture of 1.9 gr CVL, 1.9 BLMB, and 0.3 gr Pergascript Red®, available from Ciba-Geigy, in a solvent system comprising a transfer fluid mixture of methyl isobutyl carbinol (3-dimethyl-2-butanol) and Sursol®, a dibutyl biphenyl available from Koch Refining Co., and a diluent kerosene. Table V shows details and the image densities developed.

TABLE V

| Ex. | Filler Pigment | (wt. %) Kerosene | (wt. %) Sursol | (wt. %) Alcohol | (wt. %) Solids | Optical Density |
|---|---|---|---|---|---|---|
| 37 | Clay | 50 | 25 | 25 | 40 | 0.45 |
| 38 | Clay | 50 | 30 | 20 | 40 | 0.35 |
| 39 | Silica | 50 | 30 | 20 | 40 | 0.48 |
| 40 | " | 50 | 25 | 25 | 40 | 0.48 |
| 41 | " | 50 | 20 | 30 | 40 | 0.48 |
| 42 | " | 50 | 10 | 40 | 40 | 0.48 |

As seen, the added pigment fillers did not significantly decrease optical density. Applicants consider that Example 40's decrease is due to the decrease in the amount of alcohol for dissolving the Bisphenol A. As was expected, the silica seemed to counteract the effects of changes in the solvent since it has some color developing ability. Example 39 is considered very significant because of good optical density from the color developing composition and CF sheet of the invention and a lower cost alcoholic solvent system.

The CF sheets without added pigment were also developed with prepared CB sheets. A leuco dye mixture of Crystal Violet Lactone (CVL: 1.9 g), Benzoyl Leuco methylene blue (BLMB: 1.9 g.) and Pergascript Red I-6B (0.3 g) from Ciba-Geigy were dissolved in pentyl acetate (190 cc). At room temperature catalyst (Desmondue N-100, 7.5 g and Mondur MRS, 6.0 g. from Mobay Chemical Co.) were added to the above solution and solubilized. This mixture constitutes the oil phase. The aqueous phase was made by dissolving 11 g Klucel-L (Hydroxypropyl cellulose, from Hercules) in 400 cc water. A catalyst, Cymel 301, (1.0 g), from Cyanamid and a surfactant, sulfated Castor oil (1.0 g) were added to the aqueous mixture. The oil phase was added after the aqueous phase had been adjusted to ph 4 with 16% acetic acid solution. The mixture was blended with a Waring blender from 1–3 minutes, transferred to a reactor and stirred gently for 16 hours at 50°–55° C.

Microscapsules formed were 6–10 microns in diameter. The microcapsule mixture was adjusted to pH=7 with 1% NaOH solution. Then it was coated on base stock paper and imaged with the CF sheet of Example 34 (40% solids). Image intensity of 0.45 was obtained. With the dye concentrations of 3% used commercially, higher image intensity is expected. For comparison the CB sheet was imaged with CF sheets of Appleton, Mead, Boise Cascade (all phenolic resin type) and Koehler (acid treated clay), and O.D. of 0.45–0.55 were obtained.

A second CB sheet was made as above with the exception that instead of using 190 cc pentylacetate, the following solvent mixture was used: 57 cc pentylacetate and 133 cc Sursol-290 (isobutylbiphenyl) manufactured by Koch Refining Co.). Image development was 0.40. A third CB sheet was prepared as above except that 57 cc of 4-methyl-2-pentanone and 133 cc Sursol 290 were used as the color former solvent. Image intensity was also 0.40.

The CF sheets of Example 34 and 36 were also solution developed with the above 2% dye mixture dissolved in dimethylnapthalene. The image intensity was 0.45 with Ex. 34 (5% BPA) and 0.55 with Ex. 36 (8% BPA).

EXAMPLES 43–47

Dilution of the 5% BPA/$CaCO_3$ color developer dispersion with water can cause problems with flocculation of the bisphenol. Examples 43–47 are stability tests of diluted dispersions containing various levels of protective colloid.

A 73.77% solids slurry containing $CaCO_3$ having a particle size distribution of 99.8% $<$ 12 $\mu$m and Colloid 230 at 20 lbs./ton $CaCO_3$ level were mixed for 30 minutes with sufficient Bisphenol A to be 5% by weight of the $CaCO_3$. The feed slurry was then milled in 3 passes through a 4 liter Netzsch mill operating at 85% volume with 1/32" ceramic media at 1500–2100 rpm. Maximum temperature was 46° C. The resulting color developer dispersion (Example 43) had a particle size of 99.8% < 4 μm and was then mixed with protective colloid, and diluted 1/1 by weight with water. Table VI gives amounts of colloid added, the calculated % solids before dilution, the thixotropic index, measured viscosities, and the extent of flocculation. The polyvinyl alcohol (PVOH) was a 20% solution of VINOL ® 205 and the carboxymethylcellulose (CMC) was a 5% solution of Hercules CMC 7LT.

TABLE VI

| Ex. | Calc. Solids % | Brookfield Vis. at Var. RPM 2.5 | 20 | T/I |
|---|---|---|---|---|
| 43 | 72.5 | 3,800 | 850 | 4.47 |
| 44 (.2% CMC) | 69.8 | 20,480 | 3,605 | 5.61 |
| 45 (.2% PVOH) | 72.0 | 16,000 | 3,200 | 5.0 |
| 46 (.1% PVOH) | 72.3 | 9,360 | 2,350 | 3.98 |

| Ferranti-Shirley Poise at 10,000 Sec-1 | BPA Flocculation Fresh 1-1 Water Reduction | BPA Flocculation After 2 Weeks 1-1 Water Reduction |
|---|---|---|
| (43) .551 | Severe | Severe |
| (44) .667 | None | Moderate |
| (45) .725 | None | Slight |
| (46) .667 | Very Slight | Moderate |

Amounts of PVOH and CMC are on active basis of total calcium carbonate weight.

The results show that the color developer dispersion can be stabilized by a protective colloid for extended periods. As seen in the flocculation results, 0.2 wt. % polyvinyl alcohol was more effective than 0.2 wt. % carboxymethyl cellulose, although both are adequate. CMC was slightly more effective than 0.1 wt. % PVOH. The thixotropic index is the ratio of the Brookfield 2.5 rpm viscosity to the 20 rpm viscosity, and all 4 dispersions showed good thixotropic behavior, i.e., thinner at higher shear. The Ferranti-Shirley high shear rate viscosities are also good.

EXAMPLES 47–49

Examples 47, 48 and 49 are coating colors made from the dispersions of Examples 43, 44 and 45, respectively. The colors were made the same day as the dispersions by mixing on a dry solids basis 100 parts of the undiluted dispersion with 5 parts starch and 10 parts DOW 620 styrene-butadiene latex. The physical data of all three colors were: pigment volume content, 74%; pigment-/binder weight ratio, 6.7/1; binder/pigment weight ratio, 15/100; and total solids, 60 weight %.

The rheology and stability of the colors was then examined by measuring viscosity at 25° C. and diluting the colors with an equal wt. of water. Table VII gives the details.

TABLE VII

| Ex. | Brookfield Visc. (20 rpm) Poise | ICI Cone & Plate Poise 10,000 $sec^{-1}$ | Floccul. Initial Dilution | Floccul. After 2 Wks. |
|---|---|---|---|---|
| 47 | 2,225 | .28 | Severe | Severe |
| 48 | 4,170 | .4 | None | Slight |
| 49 | 2,180 | .29 | None | Slight |

The results show excellent rheological properties in all three colors. The critical high shear viscosities were measured on a cone and plate instrument and are ideal since high shear rate (10,000 $sec^{-1}$) viscosities below about 1½ poise must be achieved to permit coating. The high shear viscosities were also examined by rheogram plots of Hercules viscosities which also showed close to ideal behavior. The low shear rate Brookfield viscosities are acceptable although below about 2000 poise at low shear rate is more desirable. In sum, these 60 wt. % solids coating colors show close to ideal coating rheology.

The dilution tests showed both CMC and PVOH as effective protective colloids for preventing significant degradation of the color. Because of the lower viscosity, particularly at low shear rates, colors with PVOH are preferred.

Other coating colors using only the Dow latex as a binder were formulated at pH 8 and 9.5, % solids of 59, 66, 68 and 71, and pigment/binder ratios of 7/1 and 24/1. The rheology of these coatings at high shear rates was also excellent.

As is seen in the Examples, the bisphenol/$CaCO_3$ admixture of the invention is useful in developing image density above 0.50 when formulated in a coating color, coated onto a CF support sheet, and paired with a leuco dye CB sheet. In addition, coating colors comprising the admixture have excellent high shear rate viscosities below about 1.5 poise even at high solids contents above 50 wt. % which have not previously been used in carbonless paper coating colors.

However, the above discussion is intended to be illustrative only and is not to be considered as limiting. Rather, the scope of the invention is given by the following claims.

We claim:

1. A color developing CF sheet for pressure sensitive recording systems comprising a support coated with a coating composition comprising calcium carbonate and a monomeric bisphenol having a general formula:

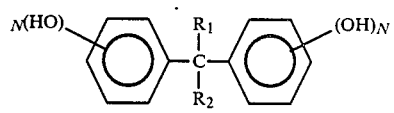

wherein N is 1, 2, 3, 4, or 5, and $R_1$ and $R_2$ are the same or different and are hydrogen, alkyl, substituted alkyl, amino or substituted amino, wherein weight ratio of bisphenol to calcium carbonate is about 2 to about 20 parts per 100 parts calcium carbonate and the calcium carbonate content of the coating is at least 30 dry weight percent.

2. The CF sheet of claim 1 further comprising a filler of talc, kaolin, or silica wherein $CaCO_3$ content of the coating is at least 50 weight %.

3. The CF sheet of claim 1 wherein the bisphenol is 4,4'-isopropylidenediphenol.

4. The CF sheet of claim 1 wherein substantially all of the calcium carbonate is smaller than 5 μm.

5. The CF sheet of claim 1 further comprising a systrene-butadiene latex binder and wherein the weight ratio of bisphenol to calcium carbonate is about 4 to about 8 parts per 100 parts $CaCO_3$ and the binder to pigment weight ratio is about 5 to about 30 parts per 100 parts $CaCO_3$ and bisphenol.

6. The CF sheet of claim 5 wherein coating weight is about 4 to about 10 gr./$m^2$.

7. A color developing CF sheet for pressure sensitive recording systems comprising a support coated with a color developer composition comprising calcium carbonate and a monomeric bisphenol having a general formula:

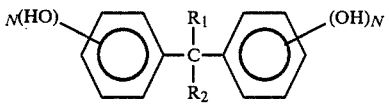

wherein N is 1, 2, 3, 4, or 5, and $R_1$ and $R_2$ are the same or different and are hydrogen, alkyl substitued alkyl, amino or substituted amino, wherein weight ratio of bisphenol to calcium carbonate is about 2 to about 20 parts per 100 parts calcium carbonate and the calcium carbonate content of the color developer composition is at least 50 dry weight %.

8. A manifold for pressure sensitive recording comprising: (a) at least one CF sheet comprising a support coated with a coating composition comprising calcium carbonate and a monomeric bisphenol having a general formula:

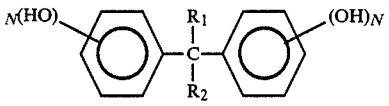

wherein N is 1, 2, 3, 4, or 5, and $R_1$ and $R_2$ are the same or different and are hydrogen, alkyl, substituted alkyl, amino or subtituted amino; wherein weight ratio of bisphenol to calcium carbonate is about 2 to about 20 parts per 100 parts calcium carbonate and calcium carbonate comprises at least 30 dry weight percent of the coating; and (b) at least one CB sheet comprising a support coated with a microencapsulated solution of a color former in a solvent in which sufficient bisphenol is soluble to react with the color former to form an image having an image density, measured at 500 nm, greater than about 0.40.

9. The manifold of claim 8 wherein the bisphenol is 4,4'-isopropylidenediphenol.

10. The manifold of claim 8 wherein the solvent dissolves at least about 0.2 gr. bisphenol per 10 cubic centimeters of solvent.

11. The manifold of claim 8 wherein the solvent system comprises a transfer fluid and a diluent, having a weight ratio of diluent to transfer fluid comprising about 1:1 to about 4:1.

12. A method for making a pressure-sensitive recording manifold capable of developing an image having an image density of at least 0.50, as measured at 500 nm, comprising:

(a) forming a coating color comprising 4,4'-isopropylidenediphenol and $CaCO_3$ wherein weight ratio of the phenol to $CaCO_3$ is about 4 to about 10 parts per 100 parts $CaCO_3$ and $CaCO_3$ comprises at least 50 dry weight % of the coating color;

(b) coating the color onto a support and drying to produce a CF sheet;

(c) pairing the CF sheet with a CB sheet comprising a support coated with microcapsules containing a leuco dye color former dissolved in an alcohol having a carbon number of 4 to 12.

* * * * *

UNITED STATES PATENT OFFICE
CERTIFICATE OF CORRECTION

Patent No. 4,755,501 Dated July 5, 1988

Inventor(s) Yew C. Chang and Richard S. Lamar

It is certified that error appears in the above-identified patent and that said Letters Patent are hereby corrected as shown below:

| Column | Line | |
|---|---|---|
| 14 | 41 | "(0005 gr.)" should read --(.05 gr.)-- |
| 4 | formula | " 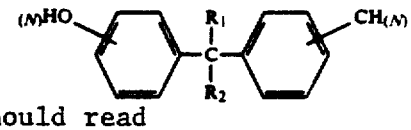 " |

should read

-- 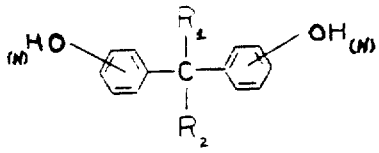 --

| | | |
|---|---|---|
| 15 | 8 | (Table II) "4-pentyl phenol" should read --4-penty phenol-- |

Signed and Sealed this

Sixth Day of December, 1988

*Attest:*

*Attesting Officer*

DONALD J. QUIGG

*Commissioner of Patents and Trademarks*